US010527382B2

(12) United States Patent
Trpkovski

(10) Patent No.: US 10,527,382 B2
(45) Date of Patent: Jan. 7, 2020

(54) NON-PLANAR RISER PLATES

(71) Applicant: P.T. Archery LLC, Prairie Du Sac, WI (US)

(72) Inventor: Paul Trpkovski, Kailua Kona, HI (US)

(73) Assignee: P.T. Archery LLC, Prairie Du Sac, WI (US)

( * ) Notice: Subject to any disclaimer, the term of this patent is extended or adjusted under 35 U.S.C. 154(b) by 0 days.

(21) Appl. No.: 15/914,778

(22) Filed: Mar. 7, 2018

(65) Prior Publication Data

US 2018/0306549 A1 Oct. 25, 2018

Related U.S. Application Data

(60) Provisional application No. 62/487,347, filed on Apr. 19, 2017.

(51) Int. Cl.

| | |
|---|---|
| ***F41B 5/10*** | (2006.01) |
| ***F41B 5/00*** | (2006.01) |
| ***F41B 5/14*** | (2006.01) |

(52) U.S. Cl.

CPC ..... *F41B 5/0031* (2013.01); *F41B 5/10* (2013.01); *F41B 5/1403* (2013.01); *F41B 5/0094* (2013.01)

(58) Field of Classification Search

CPC ..... F41B 5/10; F41B 5/0031; F41B 5/0094; F41B 5/1403

USPC ..... 124/23.1, 25.6, 86, 88

See application file for complete search history.

(56) References Cited

U.S. PATENT DOCUMENTS

| | | | | |
|---|---|---|---|---|
| 1,526,176 | A | 2/1925 | O'connell | |
| 2,186,386 | A * | 1/1940 | Lowell | F41B 5/143 124/24.1 |
| 2,714,377 | A | 8/1955 | Mulkey | |
| 2,957,469 | A | 10/1960 | Wilkerson | |
| 3,055,353 | A | 9/1962 | Perrucci | |
| 3,238,935 | A | 3/1966 | Stanaland | |
| 3,397,685 | A | 8/1968 | Walker | |

(Continued)

FOREIGN PATENT DOCUMENTS

| | | |
|---|---|---|
| CA | 2442669 | 3/2004 |
| CA | 164369 | 4/2016 |

(Continued)

OTHER PUBLICATIONS

"Examiner's Report," for Canadian Industrial Design Application No. 164369 dated Dec. 17, 2015 (1 page).

(Continued)

*Primary Examiner* — Alexander R Niconovich

(74) *Attorney, Agent, or Firm* — Pauly, DeVries Smith & Deffner LLC

(57) ABSTRACT

Embodiments include a riser assembly for a bow. The riser assembly can include a first non-planar riser plate; and a second non-planar riser plate that is coupled to the first non-planar riser plate with one or more connectors. The first non-planar riser plate and the second non-planar riser plate define a gap there between. A width of the gap extending from the first non-planar riser plate to the second non-planar riser plate. The width of the gap varies in size such that the width of the gap at a central location of the gap is larger or smaller than the width of the gap at a location distal to the central location. Other embodiments are also included herein.

20 Claims, 14 Drawing Sheets

(56) References Cited

U.S. PATENT DOCUMENTS

| | | | | |
|---|---|---|---|---|
| 3,561,418 | A * | 2/1971 | Fredrickson | F41B 5/14 124/24.1 |
| 3,834,368 | A | 9/1974 | Geiger | |
| 3,923,036 | A | 12/1975 | Jennings et al. | |
| 4,343,286 | A | 8/1982 | Thacker | |
| 4,457,287 | A | 7/1984 | Babington | |
| 4,662,344 | A | 5/1987 | Mitchell | |
| 4,759,337 | A * | 7/1988 | Suski | F41B 5/14 124/24.1 |
| 4,957,094 | A | 9/1990 | Pickering et al. | |
| 4,976,250 | A | 12/1990 | Jeffrey | |
| 4,989,577 | A | 2/1991 | Bixby | |
| 5,092,308 | A | 3/1992 | Sheffield | |
| 5,099,819 | A | 3/1992 | Simonds et al. | |
| 5,205,268 | A * | 4/1993 | Savage | F41B 5/14 124/24.1 |
| 5,234,957 | A | 8/1993 | Mantelle | |
| 5,243,957 | A * | 9/1993 | Neilson | F41B 5/10 124/25.6 |
| 5,503,135 | A | 4/1996 | Bunk | |
| 5,651,354 | A | 7/1997 | La Haise | |
| 5,697,358 | A | 12/1997 | Campisi | |
| 5,803,070 | A | 9/1998 | Martin | |
| 5,934,265 | A | 8/1999 | Darlington | |
| 5,996,566 | A | 12/1999 | Malan | |
| 6,092,516 | A | 7/2000 | Martin et al. | |
| 6,142,133 | A | 11/2000 | Anderson | |
| 6,371,098 | B1 * | 4/2002 | Winther | F41B 5/0005 124/23.1 |
| 6,470,870 | B1 | 10/2002 | Schaar | |
| 6,715,481 | B1 * | 4/2004 | Anderson | F41B 5/10 124/23.1 |
| 6,758,204 | B1 * | 7/2004 | Goff | F41B 5/10 124/25.6 |
| 6,990,970 | B1 | 1/2006 | Darlington | |
| 7,066,165 | B2 * | 6/2006 | Perry | F41B 5/0005 124/23.1 |
| 7,823,572 | B2 | 11/2010 | Anderson | |
| 7,832,386 | B2 | 11/2010 | Bednar et al. | |
| D637,255 | S | 5/2011 | McPherson | |
| D637,679 | S | 5/2011 | McPherson | |
| 7,997,259 | B2 | 8/2011 | Wilson | |
| 8,087,405 | B2 | 1/2012 | Mitchell | |
| 8,191,541 | B2 | 6/2012 | Shaffer et al. | |
| 8,439,025 | B2 | 5/2013 | Shaffer et al. | |
| 8,522,762 | B2 | 9/2013 | Trpkovski | |
| 8,622,050 | B2 | 1/2014 | Goff et al. | |
| D701,933 | S | 4/2014 | Mcpherson | |
| 8,794,225 | B2 | 8/2014 | Bednar et al. | |
| 8,851,056 | B2 | 10/2014 | Trpkovski | |
| 8,919,332 | B2 | 12/2014 | Trpkovski | |
| 9,140,513 | B2 | 9/2015 | Trpkovski | |
| 9,354,016 | B2 | 5/2016 | Trpkovski | |
| 9,377,266 | B2 * | 6/2016 | Derus | F41B 5/0031 |
| D774,154 | S | 12/2016 | Trpkovski | |
| 9,513,079 | B1 * | 12/2016 | Missel | F41B 5/105 |
| 2007/0101980 | A1 * | 5/2007 | Sims | F41B 5/10 124/25.6 |
| 2008/0051232 | A1 | 2/2008 | Henry et al. | |
| 2008/0092868 | A1 | 4/2008 | Silverson | |
| 2010/0000504 | A1 * | 1/2010 | Trpkovski | F41B 5/0094 124/25.6 |
| 2010/0051005 | A1 * | 3/2010 | Wilson | F41B 5/10 124/25.6 |
| 2011/0030666 | A1 | 2/2011 | Darlington | |
| 2011/0303205 | A1 * | 12/2011 | Goff | F41B 5/12 124/31 |
| 2013/0112182 | A1 | 5/2013 | Martin | |
| 2013/0118463 | A1 | 5/2013 | Trpkovski | |
| 2014/0360480 | A1 | 12/2014 | Koch | |
| 2015/0114378 | A1 | 4/2015 | Trpkovski | |
| 2015/0153131 | A1 * | 6/2015 | Trpkovski | F41B 5/1426 124/25.6 |
| 2015/0369556 | A1 | 12/2015 | Trpkovski | |
| 2018/0306549 | A1 * | 10/2018 | Trpkovski | F41B 5/0031 |

FOREIGN PATENT DOCUMENTS

| | | |
|---|---|---|
| EP | 0515213 | 11/1992 |
| WO | 03006914 | 1/2003 |
| WO | 2015084840 | 6/2015 |

OTHER PUBLICATIONS

File History for U.S. Appl. No. 14/556,980 downloaded Apr. 6, 2018 (351 pages).

File History for U.S. Appl. No. 14/828,152 downloaded Apr. 6, 2018 (258 pages).

File History for U.S. Appl. No. 29/521,154 downloaded Apr. 6, 2018 (321 pages).

"International Preliminary Report on Patentability," for PCT application No. PCT/US2014/068150, dated Jun. 16, 2016 (11 pages).

"International Search Report and Written Opinion," for PCT/US2014/068150, dated Jun. 24, 2015 (15 pages).

"Invitation to Pay Additonal Fees," for PCT/US2014/068150, dated Feb. 26, 2015 (6 pages).

"Response to Examiner's Report," for Canadian Industrial Design Application No. 164369 filed with CIPO dated Mar. 31, 2016 (5 pages).

"Selected Pages from Apex Hunting web site regarding the Alien Triangle Bows," www.apexhunting.com.au Downloaded Jan. 6, 2015 (8 pages).

"Selected Pages from Liberty Archery web site regarding the Liberty Bow," www.libertyarchery.com Downloaded on Jan. 8, 2015 (22 pages).

"Selected Pages from Mathews Inc. web site regarding Bow product information," www.mathewsinc.com Downloaded on Jan. 6, 2015 (4 pages).

* cited by examiner

NON-PLANAR RISER PLATES

CLAIM OF PRIORITY

This application claims the benefit of U.S. Provisional Application No. 62/487,347, filed Apr. 19, 2017, the content of which is herein incorporated by reference in its entirety.

FIELD

Embodiments herein relate to riser plates for a bow. More specifically, embodiments herein relates to non-planar riser plates.

BACKGROUND

Archery bows have been in existence in many forms for thousands of years. Many ancient civilizations had a variety of bows that gave the bow unique features and more power. In recent years, bows have included many improvements to increase power, improve efficiency, balance, improve accuracy, and decrease the shock that the weapon produces during and after the shot. Increasing the power of bows can result in increased stresses in the riser assembly. The increased stress and compressive force in some cases has resulted in side loading or buckling the riser assembly, which can decrease accuracy. Some compound bows have power cables, and the power cables may be located or routed off-center which can also cause or add to side-loading of the riser assembly.

SUMMARY

Various embodiments provide a bow. The bow can comprise a riser assembly comprising a first non-planar riser plate and a second non-planar riser plate. The first non-planar riser plate and the second non-planar riser plate define a gap therebetween. The gap having a non-uniform width. The width being measured from a location on the first non-planar riser plate to a location on the second non-planar riser plate along a plane perpendicular to a plane defined by a drawstring. The bow can further comprise a first limb and a second limb each coupled to and extending from ends of the riser assembly. At least a portion of the first limb and at least a portion of the second limb are disposed in the gap between the first non-planar riser plate and the second non-planar riser plate. The bow can also comprise a drawstring extending from the first limb to the second limb. An inner surface of the first non-planar riser plate and an inner surface of the second non-planar riser plate are concave or convex such that the width of the gap is non-uniform.

In various embodiments the bow can further comprise a first pulley disposed at a distal end of the first limb; a second pulley disposed at a distal end of the second limb; a cable extending from the first pulley to the second pulley; a handle coupled to the riser assembly; and a cable guide coupled to the handle or the riser assembly. The drawstring extends from the first pulley to the second pulley.

In some embodiments, a vertical center plane in the gap defines a plane of symmetry for the riser assembly.

In some embodiments, a lateral plane defines a plane of symmetry for the riser assembly, wherein the lateral plane is perpendicular to the drawstring.

In some embodiments, the first non-planar riser plate and the second non-planar riser plate are substantially identical mirror versions of each other.

In some embodiments, the width of the gap varies along a vertical plane of the riser assembly.

In some embodiments, the vertical plane of the riser assembly extends from the first limb to the second limb.

In some embodiments, the first non-planar riser plate and the second non-planar riser plate comprise metal.

In some embodiments, the first non-planar riser plate and the second non-planar riser plate each have a thickness of at least 0.05 inches and not more than 1 inch.

In some embodiments, the first non-planar riser plate and the second non-planar riser plate each have a constant thickness.

In some embodiments, the width of the gap is constant along a longitudinal plane from a front of the riser assembly to a back of the riser assembly.

Various embodiments provide a bow that comprises a riser assembly, the riser assembly include a first non-planar riser plate and a second non-planar riser plate. The first non-planar riser plate and the second non-planar riser plate define a gap therebetween. A width of the gap extending from the first non-planar riser plate to the second non-planar riser plate along a plane perpendicular to a plane defined by a drawstring. The bow further comprises a first limb and a second limb each coupled to and extending from ends of the riser assembly. At least a portion of the first limb and at least a portion of the second limb are disposed in the gap between the first riser plate and the second riser plate. The bow further comprises a drawstring extending from the first limb to the second limb. The first non-planar riser plate and the second non-planar riser plate are concave. The width of the gap is smaller at a central location than the width of the gap is at a location distal to the central location.

In some embodiments, the bow can further comprise a first pulley disposed at a distal end of the first limb, a second pulley disposed at a distal end of the second limb; and one or more cables extending from the first pulley to the second pulley. The drawstring extends from the first pulley to the second pulley.

In some embodiments, a vertical center plane in the gap defines a plane of symmetry for the riser assembly.

In some embodiments, the first non-planar riser plate and the second non-planar riser plate are substantially identical mirror versions of each other.

In some embodiments, the width of the gap varies along a vertical plane of the riser assembly.

In some embodiments, the vertical plane of the riser assembly extends from the first limb to the second limb.

In some embodiments, the first non-planar riser plate and the second non-planar riser plate comprise metal.

In some embodiments, the first non-planar riser plate and the second non-planar riser plate each have a thickness of at least 0.05 inches and not more than 1 inch.

In some embodiments, the first non-planar riser plate and the second non-planar riser plate each have a constant thickness.

In some embodiments, the width of the gap is constant along a longitudinal plane from a front of the riser assembly to a back of the riser assembly.

In some embodiments, an outer surface of the first non-planar riser plate and an outer surface of the second non-planar riser plate are each concave.

In some embodiments, an inner surface of the first non-planar riser plate and an inner surface of the second non-planar riser plate are each convex.

In some embodiments, the inner surface of the first non-planar riser plate and the inner surface of the second non-planar riser plate define the gap.

Various embodiments provide a bow comprising a riser assembly comprising a first non-planar riser plate and a second non-planar riser plate. The first non-planar riser plate and the second non-planar riser plate define a gap therebetween. A width of the gap extending from the first non-planar riser plate to the second non-planar riser plate. The bow can further include a first limb and a second limb each coupled to and extending from ends of the riser assembly. At least a portion of the first limb and at least a portion of the second limb are disposed in the gap between the first riser plate and the second riser plate. The bow can also include a drawstring extending from the first limb to the second limb. The first non-planar riser plate and the second non-planar riser plate are convex. The width of the gap is larger at a central location than the width of the gap is at a location distal to the central location.

In various embodiments, the bow can further comprise a first pulley disposed at a distal end of the first limb; a second pulley disposed at a distal end of the second limb; and one or more cables extending from the first pulley to the second pulley. The drawstring extends from the first pulley to the second pulley.

In some embodiments, a vertical center plane in the gap defines a plane of symmetry for the riser assembly.

In some embodiments, a lateral center plane defines a plane of symmetry for the riser assembly.

In some embodiments, the first non-planar riser plate and the second non-planar riser plate are substantially identical mirror versions of each other.

In some embodiments, the width of the gap varies along a vertical plane of the riser assembly.

In some embodiments, the vertical plane of the riser assembly extends from the first limb to the second limb.

In some embodiments, the first non-planar riser plate and the second non-planar riser plate comprise metal.

In some embodiments, the first non-planar riser plate and the second non-planar riser plate each have a thickness of at least 0.05 inches and not more than 1 inch.

In some embodiments, the first non-planar riser plate and the second non-planar riser plate each have a constant thickness.

In some embodiments, the width of the gap is constant along a longitudinal plane from a front of the riser assembly to a back of the riser assembly.

In some embodiments, an outer surface of the first non-planar riser plate and an outer surface of the second non-planar riser plate are each convex.

In some embodiments, an inner surface of the first non-planar riser plate and an inner surface of the second non-planar riser plate are each concave.

In some embodiments, the inner surface of the first non-planar riser plate and the inner surface of the second non-planar riser plate define the gap.

Various embodiments provide a riser assembly for a bow. The riser assembly can comprise a first non-planar riser plate; and a second non-planar riser plate coupled to the first non-planar riser plate with one or more connectors. The first non-planar riser plate and the second non-planar riser plate define a gap therebetween. A width of the gap extending from the first non-planar riser plate to the second non-planar riser plate. The width of the gap varies in size such that the width of the gap at a central location of the gap is larger or smaller than the width of the gap at a location distal to the central location.

In some embodiments, an outer surface of the first non-planar riser plate and an outer surface of the second non-planar riser plate are each concave; and the width of the gap is smaller at a central location than the width of the gap is at a location distal to the central location.

In some embodiments, an inner surface of the first non-planar riser plate and an inner surface of the second non-planar riser plate are each convex, and the inner surface of the first non-planar riser plate and the inner surface of the second non-planar riser plate at least partially define the gap.

In some embodiments, an outer surface of the first non-planar riser plate and an outer surface of the second non-planar riser plate are each convex; and the width of the gap is larger at a central location than the width of the gap is at a location distal to the central location.

In some embodiments, an inner surface of the first non-planar riser plate and an inner surface of the second non-planar riser plate are each concave, and the inner surface of the first non-planar riser plate and the inner surface of the second non-planar riser plate at least partially define the gap.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures, in which.

While embodiments are susceptible to various modifications and alternative forms, specifics thereof have been shown by way of example and drawings, and will be described in detail. It should be understood, however, that the scope herein is not limited to the particular embodiments described. On the contrary, the intention is to cover modifications, equivalents, and alternatives falling within the spirit and scope herein.

DETAILED DESCRIPTION

The embodiments described herein are not intended to be exhaustive or to limit the invention to the precise forms disclosed in the following detailed description. Rather, the embodiments are chosen and described so that others skilled in the art can appreciate and understand the principles and practices.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

Hunters and other users of archery bows desire more powerful and more accurate bows. However, simply increasing the power of a bow can lead to side loading or side buckling the riser assembly, which can result in decreased accuracy. Hunters and other users of bows also desire more accurate bows.

The accuracy of a bow can, in part, be related to the amount of flexing the riser assembly experiences. Power cables are present in some bows and may be located or routed off-center, which can lead to side loading and increased likelihood of flexing. Flexing of the riser assembly can create undesirable accuracy issues with the bow. A bow riser that is exceptionally rigid can aid in achieving a more accurate bow.

One option to counter the side loading or side buckling of the riser assembly is to preload the riser assembly with a force counter to the side buckling force. In various embodiments disclosed herein the riser plates within the riser assembly can be non-planar or curved such as to be preloaded against the side buckling. In some embodiments, the riser plates can be concave. A concave riser plate can have an outer surface that is concave and an inner surface that is convex. In some embodiments, the riser plates can be convex. A convex riser plate can have an outer surface that is convex and an inner surface that is concave.

Figure 1:
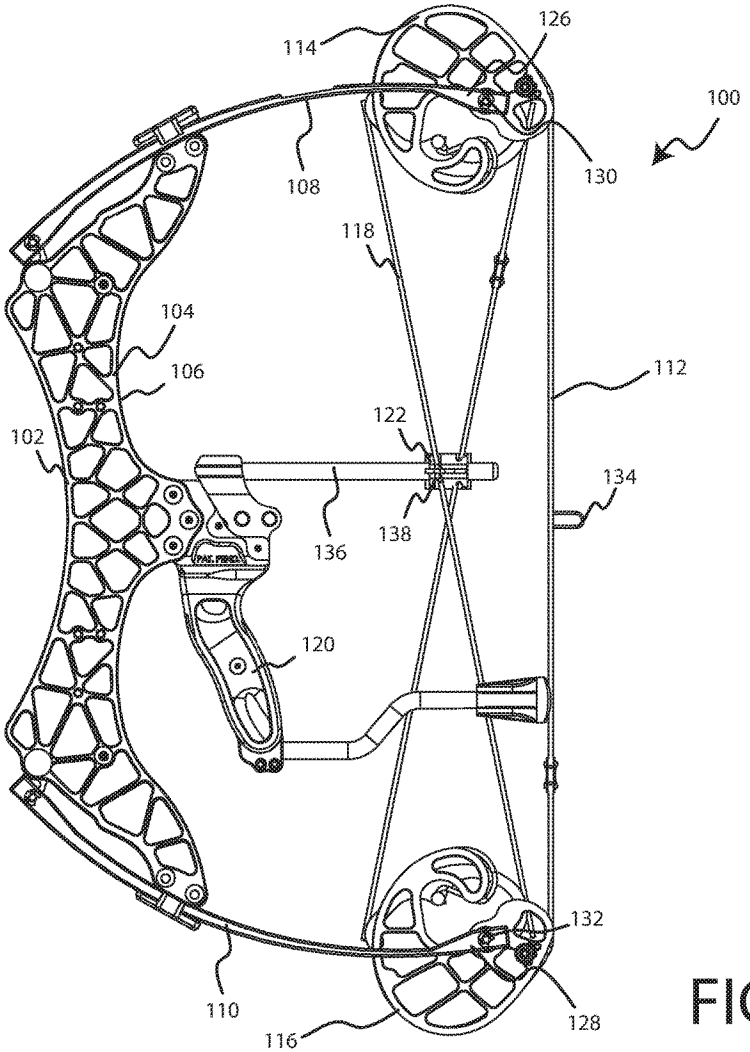
FIG. 1 is a side view of a bow, according to an embodiment.
Figure 2:
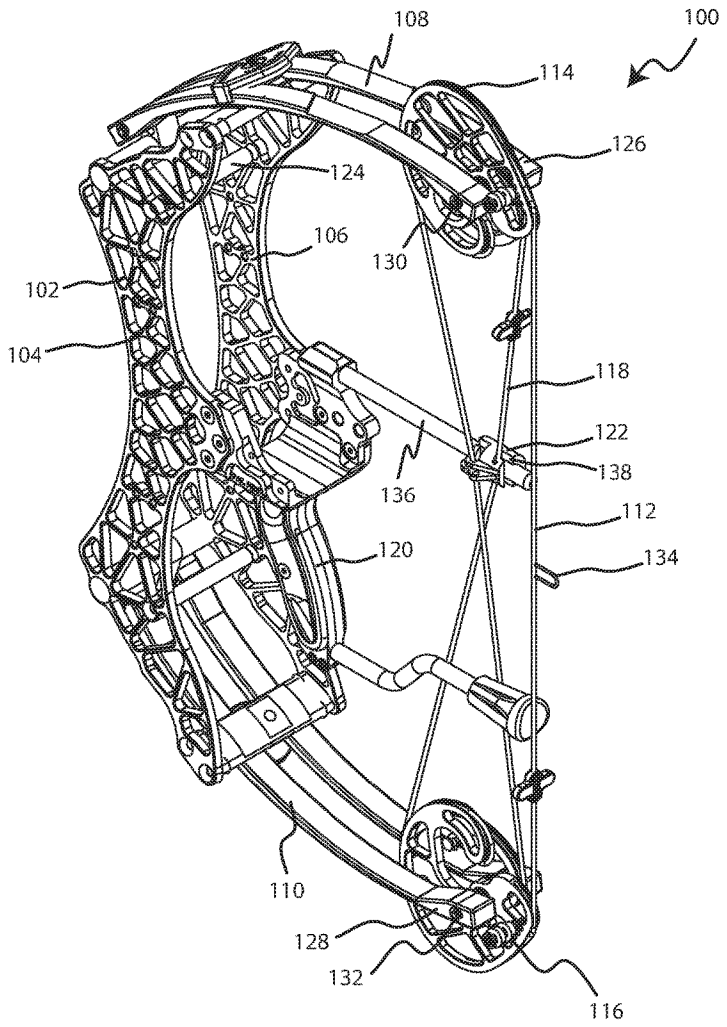
FIG. 2 is a perspective view of the bow of FIG. 1.

FIG. 1 shows a side view of a bow 100, according to an embodiment. FIG. 2 shows a perspective view of the bow 100. The bow 100 can include a riser assembly 102. The riser assembly 102 can include a first riser plate 104 and a second riser plate 106 (shown in FIG. 2). The first riser plate 104 can be coupled to the second riser plate 106 with one or more riser connectors 124. The riser assembly 102 can provide a base for the bow 100, such that other components of the bow 100 can be coupled to the riser assembly 102. In various embodiments, the riser plates 104, 106 can be non-planar or curved. In some embodiments, the riser plates 104, 106 can be curved, such that the riser plate 104, 106 defines a portion of an ellipse or circle when viewed from the rear, such as shown in FIGS. 3, 6, 8, and 11. In some embodiments, the riser plate 104, 106 can be consistently curved or have a constant curvature radius, such that riser plate 104, 106 defines a portion of a circle. In some embodiments, the riser plate 104, 106 can be constantly curved, such that no portion of the inner or outer surface is curved in an opposite direction or no portion of the inner or outer surface is planar. In some embodiments, at least one of the riser plates 104, 106 can be non-planar. In some embodiments, one riser plate 104, 106 is non-planar and one riser plate 104, 106 is planar.

The bow 100 can include two limbs, a first limb 108 and a second limb 110. The bow 100 can include a drawstring 112 extending from the first limb 108 to the second limb 110. The first limb 108 and the second limb 110 can be coupled to the riser assembly 102. The first limb 108 and the second limb 110 can extend from the riser assembly 102, such as from opposite ends of the riser assembly 102. The limbs 108, 110 can each include a proximal end 127, 129 that can be coupled to the riser assembly 102.

The bow 100 can include a first pulley 114 disposed at a distal end 126 of the first limb 108. The bow 100 can include a second pulley 116 disposed at a distal end 128 of the second limb 110. In some embodiments, the drawstring 112 can extend from the first pulley 114 to the second pulley 116. One or more cables 118 can extend from the first pulley 114 to the second pulley 116, such as to provide or store power to propel an arrow from the bow 100. The first pulley 114 can rotate around a first axle 130 and the second pulley 116 can rotate around a second axle 132.

The bow 100 can further include a handle 120. The handle 120 can be coupled to the riser assembly 102. The handle 120 can be configured to allow an archer to hold the bow 100 with his or her hand.

Figure 3:
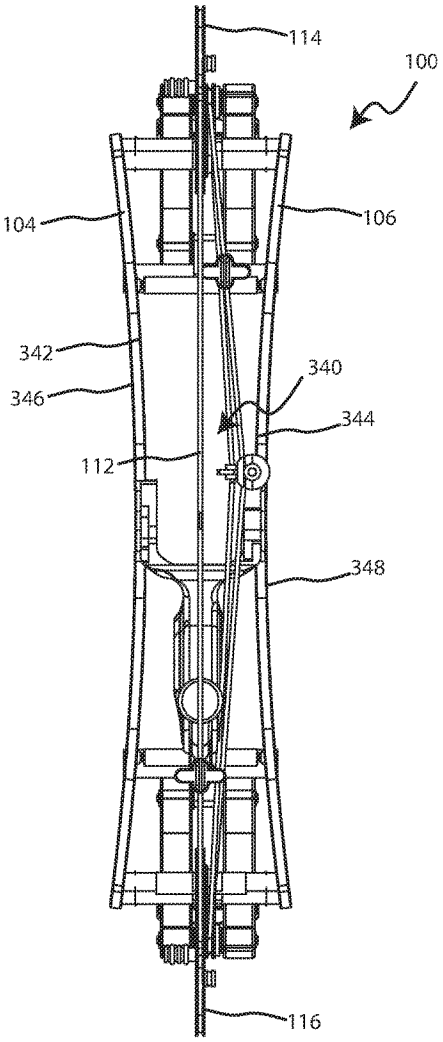
FIG. 3 is a rear view of the bow of FIG. 1.

The bow 100 can also include a cable guide 122. The cable guide 122 can be coupled to the handle 120 or the riser assembly 102. The cable guide 122 can retain or hold the cables 118 away from the path of the drawstring 112 or an arrow. The cable guide 122 can include a cable slide 136 and a slide block 138. As can be seen in FIG. 3, the cable guide 122 pulls the cables 118 to an off-center location so that the cables 122 are clear of the drawstring 112 and arrow path. The cable 118 is attached to the pulleys 114, 116 next to the drawstring 112, so that the cable 118 is off-center within the riser assembly.

In various embodiments, the distance from the first axle 130 to the second axle 132 can be at least 10 inches. In various embodiments, the distance from the first axle 130 to the second axle 132 can at least 11 inches. In various embodiments, the distance from the first axle 130 to the second axle 124 can at least 12 inches. In various embodiments, the distance from the first axle 130 to the second axle 132 can at least 13 inches. In various embodiments, the distance from the first axle 130 to the second axle 132 can at least 14 inches. In various embodiments, the distance from the first axle 130 to the second axle 132 can at least 15 inches. In various embodiments, the distance from the first axle 130 to the second axle 132 can at least 16 inches.

In various embodiments, the distance from the first axle 130 to the second axle 132 can be no more than 25 inches. In various embodiments, the distance from the first axle 130 to the second axle 132 can be no more than 24 inches. In various embodiments, the distance from the first axle 130 to the second axle 132 can be no more than 23 inches. In various embodiments, the distance from the first axle 130 to the second axle 132 can be no more than 22 inches. In various embodiments, the distance from the first axle 130 to the second axle 132 can be no more than 21 inches.

In an embodiment, the distance from the first axle 130 to the second axle 132 can be at least 16 inches and not more than 24 inches. In an embodiment, the distance from the first axle 130 to the second axle 132 can be at least 10 inches and not more than 24 inches. In an embodiment, the distance from the first axle 130 to the second axle 132 can be at least 12 inches and not more than 24 inches. In an embodiment, the distance from the first axle 130 to the second axle 132 can be at least 10 inches and not more than 22 inches. In an embodiment, the distance from the first axle 130 to the second axle 132 can be at least 12 inches and not more than 22 inches.

In an embodiment, the distance from the first axle 130 to the second axle 132 is about 25 inches. In an embodiment, the distance from the first axle 130 to the second axle 132 is about 24 inches. In an embodiment, the distance from the first axle 130 to the second axle 132 is about 23 inches. In an embodiment, the distance from the first axle 130 to the second axle 132 is about 22 inches. In an embodiment, the distance from the first axle 130 to the second axle 132 is about 21 inches. In an embodiment, the distance from the first axle 130 to the second axle 132 is about 20 inches. In an embodiment, the distance from the first axle 130 to the second axle 132 is about 19 inches. In an embodiment, the distance from the first axle 130 to the second axle 132 is about 18 inches. In an embodiment, the distance from the first axle 130 to the second axle 132 is about 17 inches. In an embodiment, the distance from the first axle 130 to the second axle 132 is about 16 inches.

Figure 4:
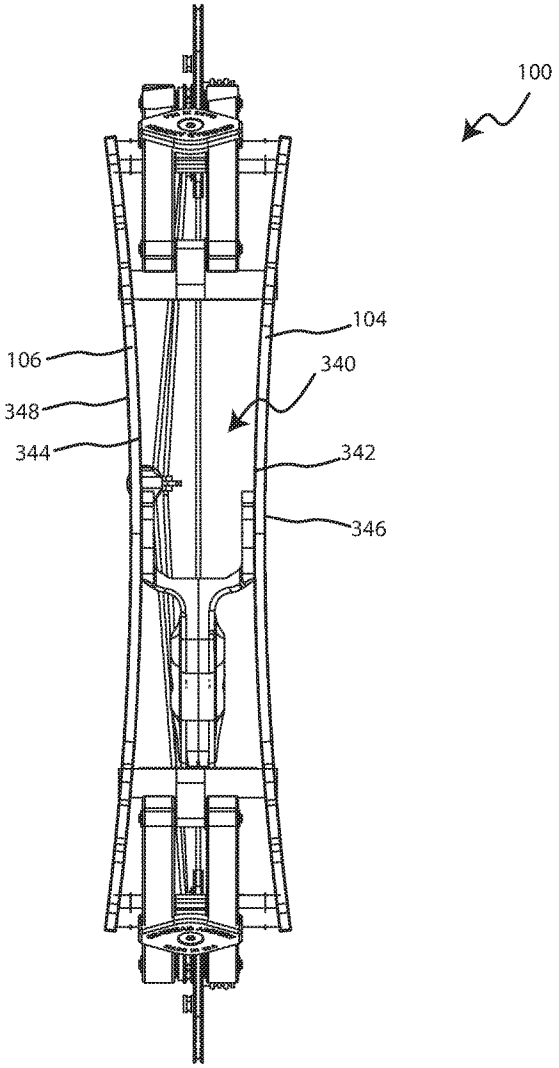
FIG. 4 is a front view of the bow of FIG. 1.

FIG. 3 shows a rear view of the bow 100. FIG. 4 shows a front view of the bow 100. The riser plates 104, 106 can define a gap 340 between the riser plates 104, 106. The gap 340 can extend from the inner surface 342 of the first riser plate 104 to the inner surface 344 of the second riser plate 106. The gap 340 can have a varying or non-uniform width depending on the configuration of the of the riser plates 104, 106. The width of the gap can be measured from a location on the first riser plate to a location on the second riser plate along a line or plane perpendicular to a plane defined by the drawstring 112. The locations on the riser plates 104, 106 can be on the inner surfaces 342, 244.

In various embodiments, the riser plates 104, 106 can be concave, such as shown in FIGS. 3 and 4. In a concave arrangement an outer surface 346, 348 of each plate 104, 106 can be concave and an inner surface 342, 344 of each plate 104, 106 can be convex. In some embodiments, a concave riser plate can refer to a riser plate where at least a portion of the outer surface of the riser plate is concave, at least a portion of the inner surface of the riser plate is convex, or at least a portion of the outer surface of the riser plate is concave and at least a portion of the inner surface is convex. In some embodiments, the entire outer surface can be concave and/or the entire inner surface can be convex. The outer surface 346, 348 can refer to the surface of the riser plate 104, 106 that faces away from the other riser plate 104, 106. The inner surface of a riser plate can refer to the surface of the riser plate 104, 106 that faces towards the other riser plate 104, 106 or at least partially defines the gap 340.

Figure 11:
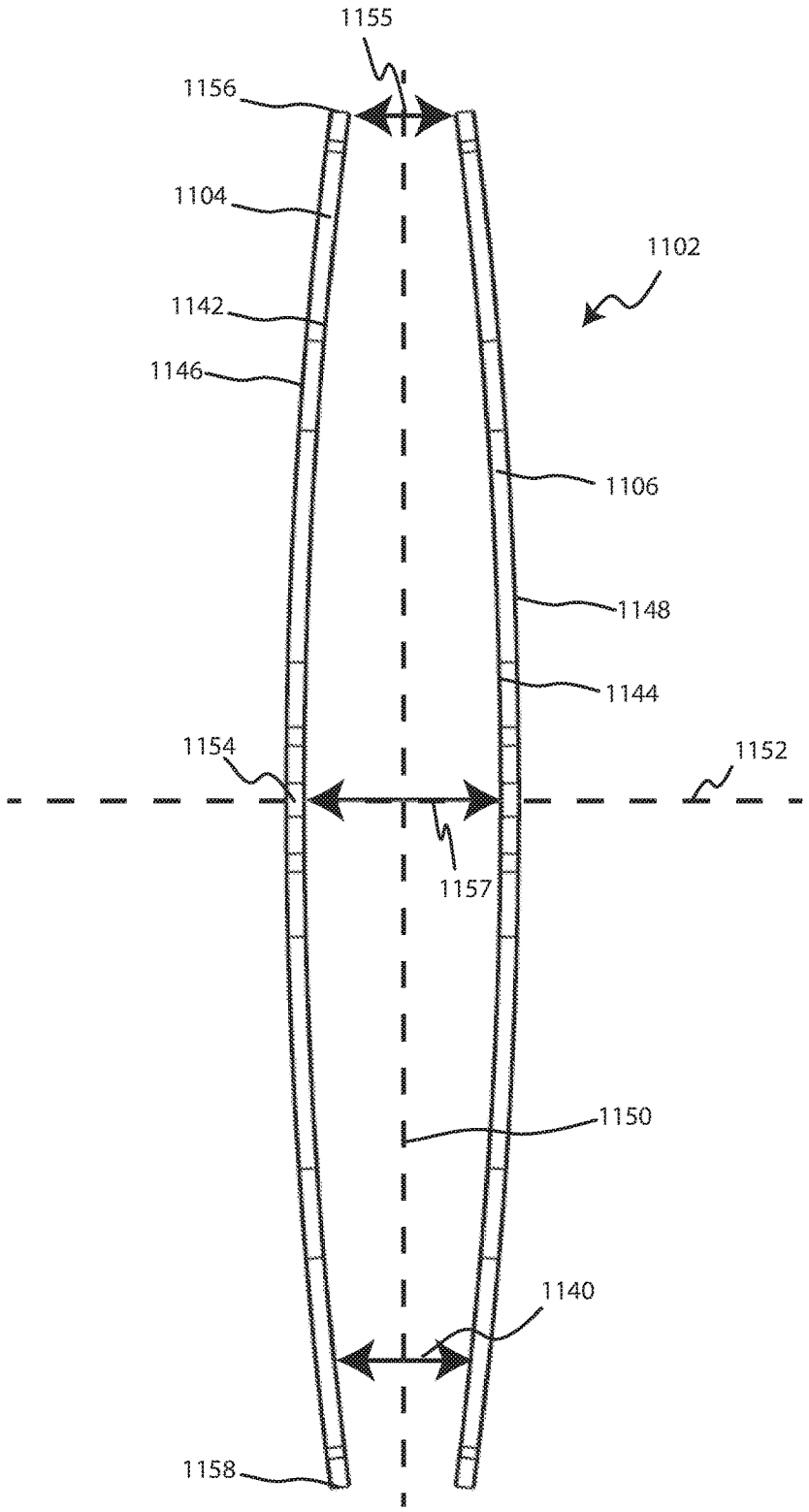
FIG. 11 is a rear view of a riser assembly, according to an embodiment.

The gap 340 can extend from the first riser plate 104 to the second riser plate 106. The gap 340 can have a width extending from the inner surface 342 of the first riser plate 104 to the inner surface 344 of the second riser plate 106. The width of the gap 340 can vary along a vertical axis or plane of the bow 100. In various embodiments, the width of the gap will be constant along a longitudinal plane, such that the width of the gap 340 at the front of the riser assembly 102 can be the same as the width of the gap at the back of the riser assembly 102. A longitudinal plane can be perpendicular to a vertical plane and parallel to the horizontal plane, such as shown in FIGS. 6 and 11.

Figure 5:
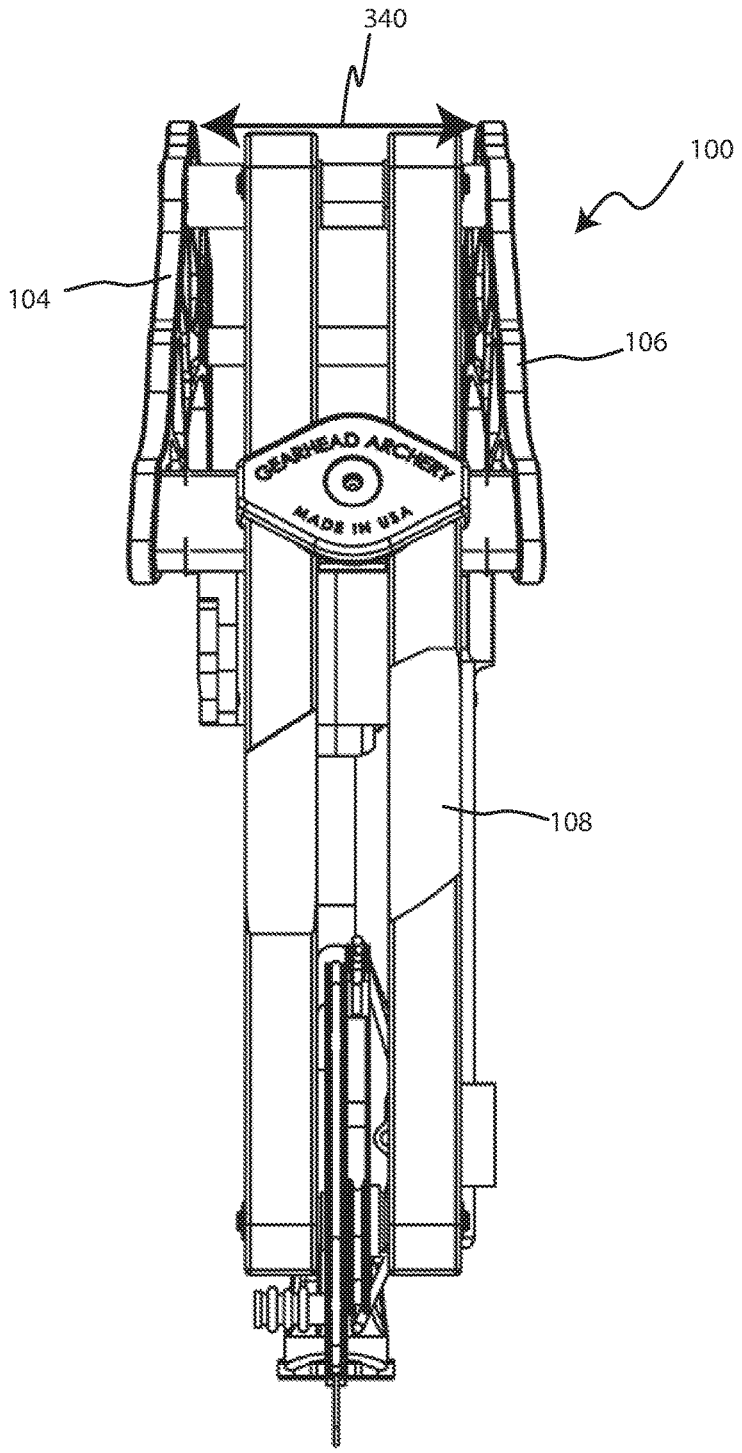
FIG. 5 is a top view of the bow of FIG. 1.

FIG. 5 shows a top view of the bow 100, according to an embodiment. In an embodiment of a bow 100 with concave riser plates 104, 106, such as shown in FIG. 5, the width of the gap 340 can be the largest at the top of the riser assembly 102. In some embodiments, the width of the gap 340 can have an equal width at the bottom of the riser assembly 102 and at the top of the riser assembly 102.

Figure 6:
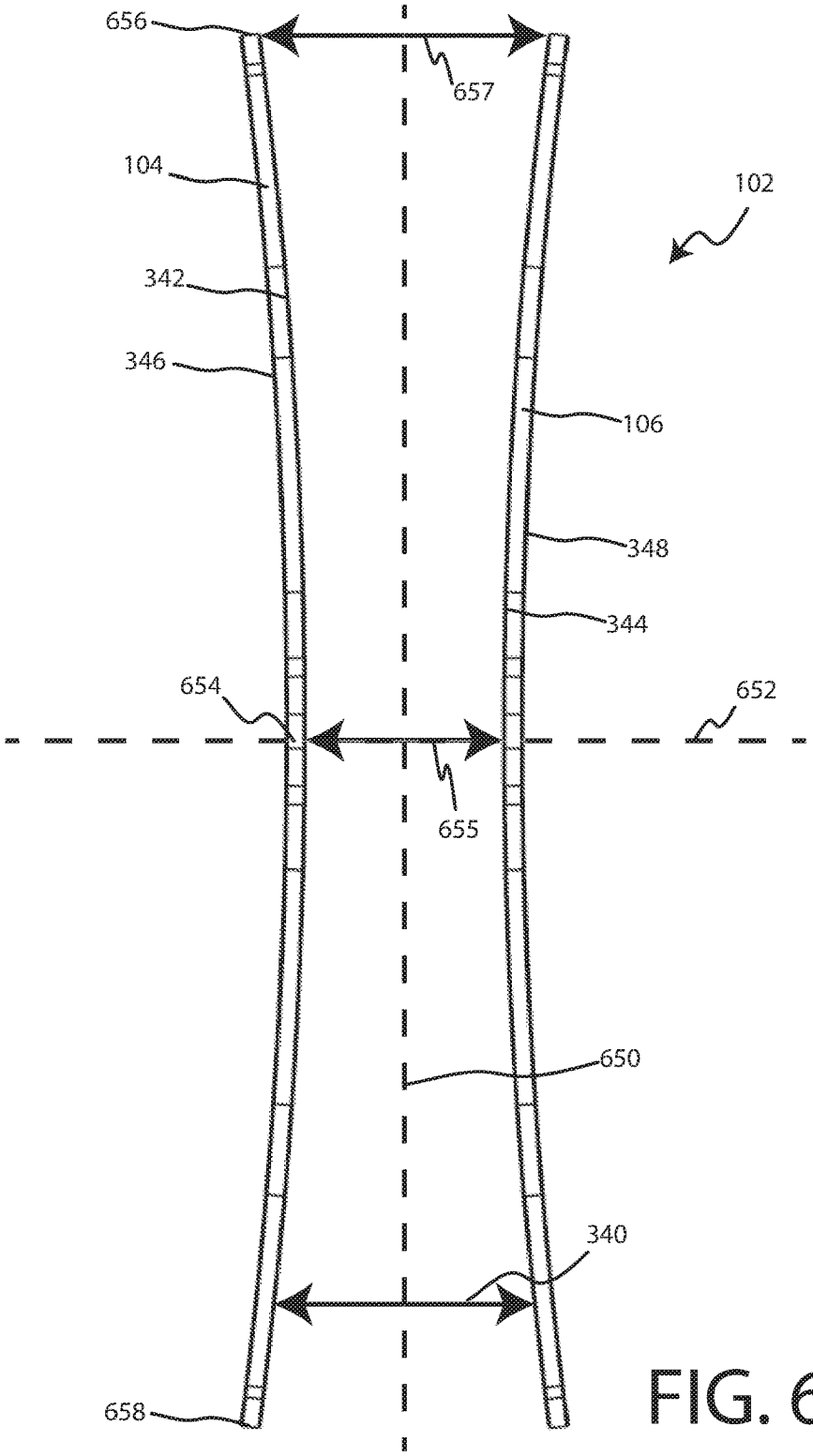
FIG. 6 is a rear view of the riser assembly from the bow of FIG. 1, according to an embodiment.

FIG. 6 shows a rear view of a riser assembly 102, according to an embodiment. In various embodiments, the riser assembly 102 can include a concave first riser plate 104 and a concave second riser plate 106.

In some embodiments, the riser assembly 102 can include a vertical plane 650 which can be a vertical plane of symmetry. The vertical plane 650 can extend from the first limb 108 to the second limb 110. In an embodiment, the vertical plane 650 can extend from a center of the first limb to a center of a second limb. In some embodiments, the riser assembly 102 can include a horizontal plane or axis 652 which can be a horizontal plane or lateral plane of symmetry. Some embodiments of the riser assembly 102 can include a vertical plane of symmetry, such as only one plane of symmetry. Some embodiments of the riser assembly 102 can include a horizontal plane of symmetry, such as only one plane of symmetry. Some embodiments of the riser assembly 102 can include a vertical plane of symmetry and a horizontal plane of symmetry, such as only one vertical plane of symmetry and only one horizontal plane of symmetry.

In an embodiment of a riser assembly 102 that includes concave riser plates 104, 106 the gap 340 can have the smallest width at a central location 654, such as at a horizontal plane of symmetry. The central location 654 can be located an equal distance from the top end 656 of the riser assembly 102 and the bottom end 658 of the riser assembly 102. In some embodiments with concave riser plates, the central location 654 can refer to a location at which the gap 340 is the smallest. In some embodiments with concave riser plates, locations more distal from a central location can have a larger gap 340 than a more central location.

In various embodiments, the width of the gap 340 can vary along the vertical plane 650, such that the width of the gap can be larger or smaller than the width of the gap 340 at another location along the vertical plane 650. In some cases, the width of the gap 340 can be identical to the width of the gap at another location, such as when the two locations are equal distance from a horizontal plane of symmetry. In some embodiments with concave riser plates 104, 106, the gap 340 can have the largest width at the top end 656 and/or bottom end 658 of the riser assembly 102. In some embodiments, the width of the gap 340 at the bottom end 658 can be equal to the width of the gap 340 at the top end 658.

In various embodiments, the first riser plate 104 and the second riser plate 106 can be substantially identical mirror versions of each other, such as when the vertical plane 650 is a vertical plane of symmetry.

In some embodiments, a riser assembly 102 can have a gap 340 that has a minimum width of at least 0.5 inches and not more than 2 inches and a maximum width at least 1 inch and not more than 6 inches. In some embodiments, a riser assembly 102 can have a gap 340 that has a minimum width of at least 1 inch and not more than 3 inches and a maximum width at least 3 inch and not more than 8 inches.

In some embodiments, the width of the widest portion 657 of the gap can be at least 1 inch and not more than 6 inches. In some embodiments, the width of the narrowest portion 655 of the gap can be at least 0.5 inches and not more than 3 inches. In various embodiments, the difference between the width at the smallest width location 655 and the width at the largest width location 657 can be at least 0.25 inches and not more than 3 inches. In various embodiments, the difference between the width at the smallest width location 655 and the width at the largest width location 657 can be at least 0.25 inches and not more than 1.5 inches. In various embodiments, the difference between the width at the smallest width location 655 and the width at the largest width location 657 can be at least 1.5 inches and not more than 3 inches. In various embodiments of a bow with an axle to axle dimension of 40 inches or greater, the difference between the width at the smallest width location 655 and the width at the largest width location 657 can be at least 1.5 inches and not more than 3 inches In some embodiments, the width at the smallest width location 655 can be about or at least 0.25 inches less than the width at the largest width location 657. In some embodiments, the width at the smallest width location 655 can be about or at least 0.5 inches less than the width at the largest width location 657. In some embodiments, the width at the smallest width location 655 can be about or at least 0.75 inches less than the width at the largest width location 657. In some embodiments, the width at the smallest width location 655 can be about, at least or at most 1 inch less than the width at the largest width location 657. In some embodiments, the width at the smallest width location 655 can be about, at least or at most 1.25 inches less than the width at the largest width location 657. In some embodiments, the width at the smallest width location 655 can be about, at least or at most 1.5 inches less than the width at the largest width location 657. In some embodiments, the width at the smallest width location 655 can be about or at most 2 inches less than the width at the largest width location 657. In some embodiments, the width at the smallest width location 655 can be about or at most 2.5 inches less than the width at the largest width location 657. In some embodiments, the width at the smallest width location 655 can be about or at most 3 inches less than the width at the largest width location 657.

Figure 7:
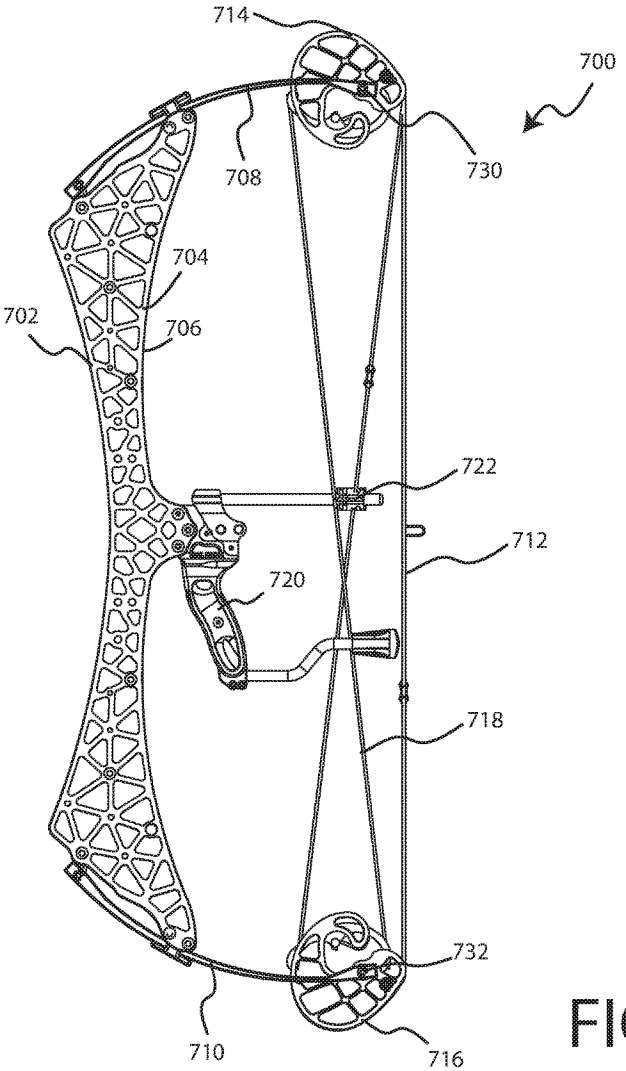
FIG. 7 is a side view of a bow, according to an embodiment.

FIG. 7 shows a side view of a bow 700, according to an embodiment. FIG. 7 shows a bow 700 similar to the bow 100; however, the bow 700 is larger than the bow 100. Similar to the bow 100 shown in FIGS. 1-6, the bow 700 can include a riser assembly 702 with a first riser plate 704 and a second riser plate 706. The bow 700 can further include a first limb 708, a second limb 710, and a drawstring 712 extending between the two limbs 708, 710. The bow 700 can include one or more pulleys 714, 716 disposed at the ends of the limbs 708, 710, and one or more cables 718 extending between the pulleys 714, 716. The first pulley 714 can rotate around a first axle 730 and the second pulley 716 can rotate around a second axle 732. The bow can also include a handle 720 and a cable guide 722.

In various embodiments, the distance from the first axle 730 to the second axle 732 can be at least 24 inches. In various embodiments, the distance from the first axle 730 to the second axle 732 can at least 25 inches. In various embodiments, the distance from the first axle 730 to the second axle 124 can at least 26 inches. In various embodiments, the distance from the first axle 730 to the second axle 732 can at least 27 inches. In various embodiments, the distance from the first axle 730 to the second axle 732 can at least 28 inches. In various embodiments, the distance from the first axle 730 to the second axle 732 can at least 30 inches. In various embodiments, the distance from the first axle 730 to the second axle 732 can at least 32 inches. In various embodiments, the distance from the first axle 730 to the second axle 732 can at least 34 inches.

In various embodiments, the distance from the first axle 730 to the second axle 732 can be no more than 48 inches. In various embodiments, the distance from the first axle 730 to the second axle 732 can be no more than 46 inches. In various embodiments, the distance from the first axle 730 to the second axle 732 can be no more than 44 inches. In various embodiments, the distance from the first axle 730 to the second axle 732 can be no more than 42 inches. In various embodiments, the distance from the first axle 730 to the second axle 732 can be no more than 40 inches. In various embodiments, the distance from the first axle 730 to the second axle 732 can be no more than 38 inches. In various embodiments, the distance from the first axle 730 to the second axle 732 can be no more than 36 inches. In various embodiments, the distance from the first axle 730 to the second axle 732 can be no more than 35 inches. In various embodiments, the distance from the first axle 730 to the second axle 732 can be no more than 34 inches. In various embodiments, the distance from the first axle 730 to the second axle 732 can be no more than 33 inches. In various embodiments, the distance from the first axle 730 to the second axle 732 can be no more than 32 inches. In various embodiments, the distance from the first axle 730 to the second axle 732 can be no more than 31 inches. In various embodiments, the distance from the first axle 730 to the second axle 732 can be no more than 30 inches.

In an embodiment, the distance from the first axle 730 to the second axle 732 can be at least 15 inches and not more than 35 inches. In an embodiment, the distance from the first axle 730 to the second axle 732 can be at least 16 inches and not more than 33 inches. In an embodiment, the distance from the first axle 730 to the second axle 732 can be at least 15 inches and not more than 30 inches. In an embodiment, the distance from the first axle 730 to the second axle 732 can be at least 16 inches and not more than 30 inches. In an embodiment, the distance from the first axle 730 to the second axle 732 can be at least 16 inches and not more than 24 inches. In an embodiment, the distance from the first axle 730 to the second axle 732 can be at least 25 inches and not more than 48 inches.

In an embodiment, the distance from the first axle 730 to the second axle 732 is about 25 inches. In an embodiment, the distance from the first axle 730 to the second axle 732 is about 26 inches. In an embodiment, the distance from the first axle 730 to the second axle 732 is about 27 inches. In an embodiment, the distance from the first axle 730 to the second axle 732 is about 28 inches. In an embodiment, the distance from the first axle 730 to the second axle 732 is about 29 inches. In an embodiment, the distance from the first axle 730 to the second axle 732 is about 30 inches.

Figure 8:
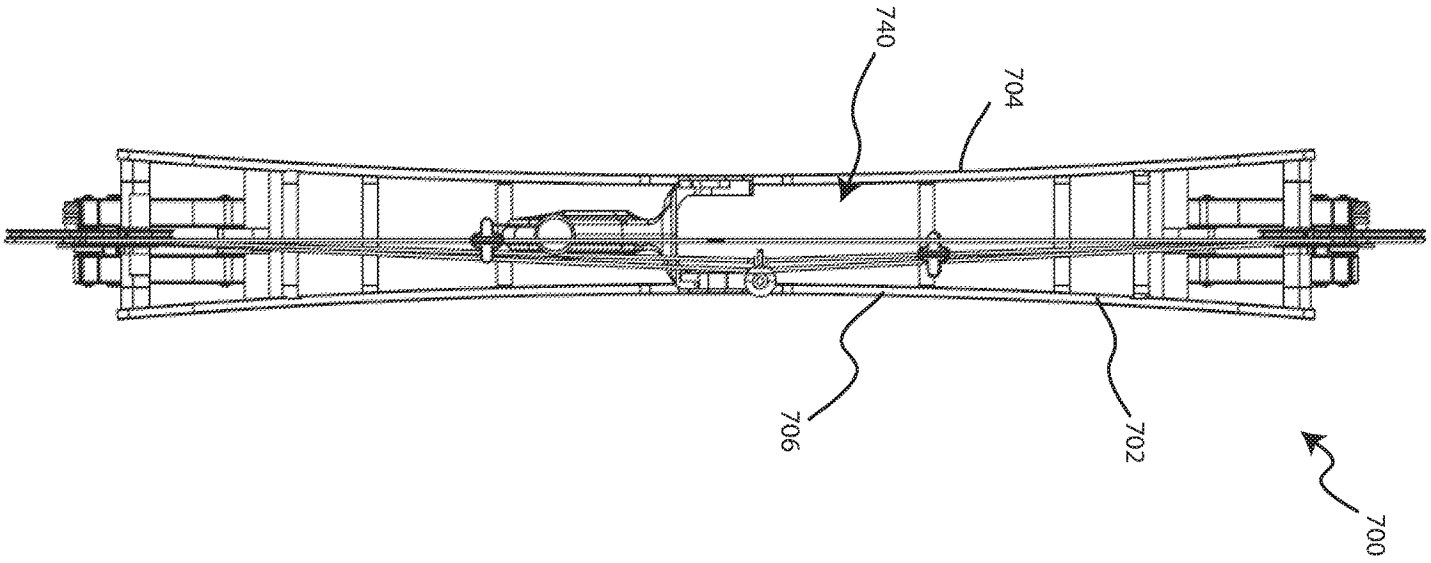
FIG. 8 is a rear view of the bow of FIG. 7.
Figure 9:
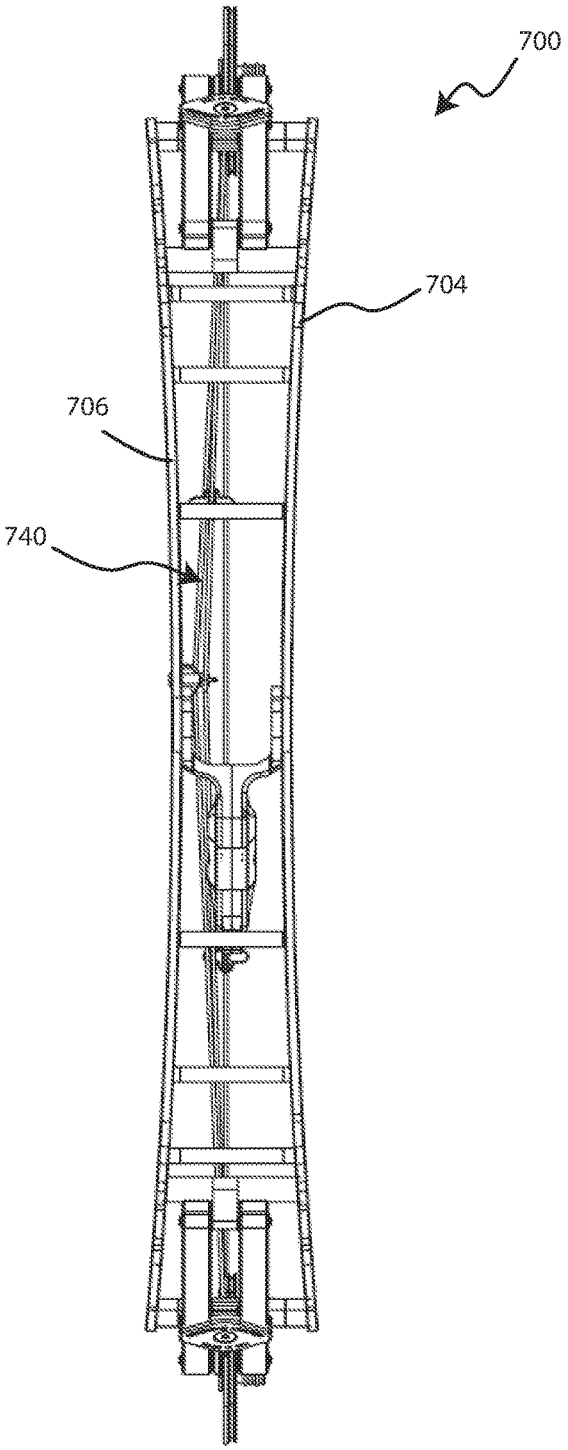
FIG. 9 is a front view of the bow of FIG. 7.

FIG. 8 shows a rear view of the bow 700, according to an embodiment. FIG. 9 shows a front view of the bow 700. Similar to the bow 100 shown in FIGS. 1-5, the riser assembly 702 can include concave riser plates 704, 706.

Figure 10:
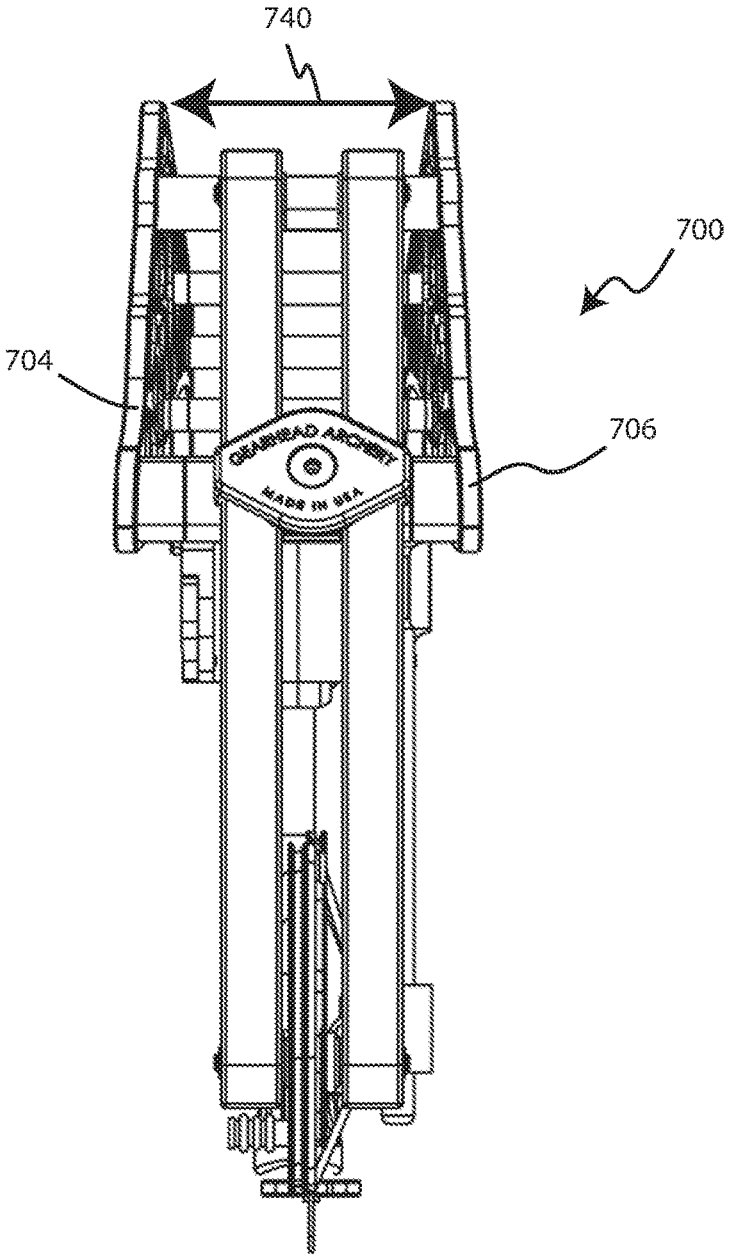
FIG. 10 is a top view of the bow of FIG. 7.

FIG. 10 shows a top view of the bow 700, according to an embodiment. As discussed in regards to FIG. 6, a bow with concave riser plates can have a gap 740 with a varying width. The gap 740 can have its largest width at the top or bottom of the riser assembly 702. The width of the gap 740 can be symmetrical, such that the width of the gap 740 at the top of the riser assembly 702 is the same as the width of the gap 740 at the bottom of the riser assembly 702.

FIG. 11 shows a rear view of a riser assembly 1102, according to an embodiment. The riser assembly 1102 can be of similar size to the riser assembly 102, shown in FIG. 6. In various embodiments, the riser assembly 1102 can include a convex first riser plate 1104 and a convex second riser plate 1106. A convex riser plate can refer to a riser plate where at least a portion of the outer surface of the riser plate is convex, at least a portion of the inner surface of the riser plate is concave, or at least a portion of the outer surface of the riser plate is convex and at least a portion of the inner surface of the riser plate is concave. In some embodiments, the entire outer surface can be convex and/or the entire inner surface can be concave.

The outer surface 1146, 1148 can refer to the surface of the riser plate 1104, 1106 that faces away from the other riser plate 1104, 1106. The inner surface 1142, 1144 of a convex plate 1104, 1106 can be concave. The inner surface of a riser plate can refer to the surface of the riser plate 1104, 1106 that faces towards the other riser plate 1104, 1106 or at least partially defines the gap 1140.

In some embodiments, the riser assembly 1102 can include a vertical plane 1150 which can be a vertical plane of symmetry. The vertical plane 1150 can extend from the first limb to the second limb. In some embodiments, the riser assembly 1102 can include a horizontal plane 1152 which can be a horizontal plane or lateral plane of symmetry. Some embodiments of the riser assembly 1102 can include a vertical plane of symmetry, such as only one plane of symmetry. Some embodiments of the riser assembly 1102 can include a horizontal plane of symmetry, such as only one plane of symmetry. Some embodiments of the riser assembly 1102 can include a vertical plane of symmetry and a horizontal plane of symmetry, such as only one vertical plane of symmetry and only one horizontal plane of symmetry.

In an embodiment of a riser assembly 1102 that includes convex riser plates 1104, 1106 the gap 1140 can have the largest width at a central location 1154, such as at a horizontal plane of symmetry. The central location 1154 can be located an equal distance from the top end 1156 of the riser assembly 1102 and the bottom end 1158 of the riser assembly 1102. In some embodiments with convex riser plates, the central location can refer to a location at which the gap 1140 is the largest. In some embodiments with convex riser plates, locations more distal from the central location can have a smaller gap 1140 than a more central location.

In various embodiments, the width of the gap 1140 can vary or be non-uniform along the vertical plane 1150, such that the width of the gap 1140 can be larger or smaller than the width of the gap 1140 at another location along the vertical plane 1150. In some cases, the width of the gap 1140 can be identical to the width of the gap 1140 at another location, such as when the two location are equal distance from a horizontal plane of symmetry. In some embodiments with convex riser plates 1104, 1106, the gap 1140 can have the smallest width at the top end 1156 and/or bottom end 1158 of the riser assembly 1102. In some embodiments, the width of the gap 1140 at the bottom end 1158 can be equal to the width of the gap 1140 at the top end 1156.

In various embodiments, the first riser plate 1104 and the second riser plate 1106 can be substantially identical mirror versions of each other, such as when the vertical plane 1150 is a vertical plane of symmetry.

In some embodiments, a riser assembly 1102 can have a gap 1140 that has a width at a smallest width location 1155 of at least 0.5 inches and not more than 2 inches and a width at a largest width location 1157 at least 1 inch and not more than 6 inches. In some embodiments, a riser assembly 1102 can have a gap 1140 that has a width at a smallest width location 1155 of at least 0.5 inches and not more than 3 inches and a width at a largest width location 1157 at least 1 inch and not more than 6 inches. In some embodiments, a riser assembly 1102 can have a gap 1140 that has a width at a smallest width location of at least 1 inch and not more than 3 inches and a width at a largest width location width at least 3 inch and not more than 8 inches.

The differences in the smallest width and largest width discussed herein with reference to FIG. 6 can also apply to the embodiments of the other FIGS., including the smallest width 1155 and largest width 1157 of FIG. 11.

Figure 12:
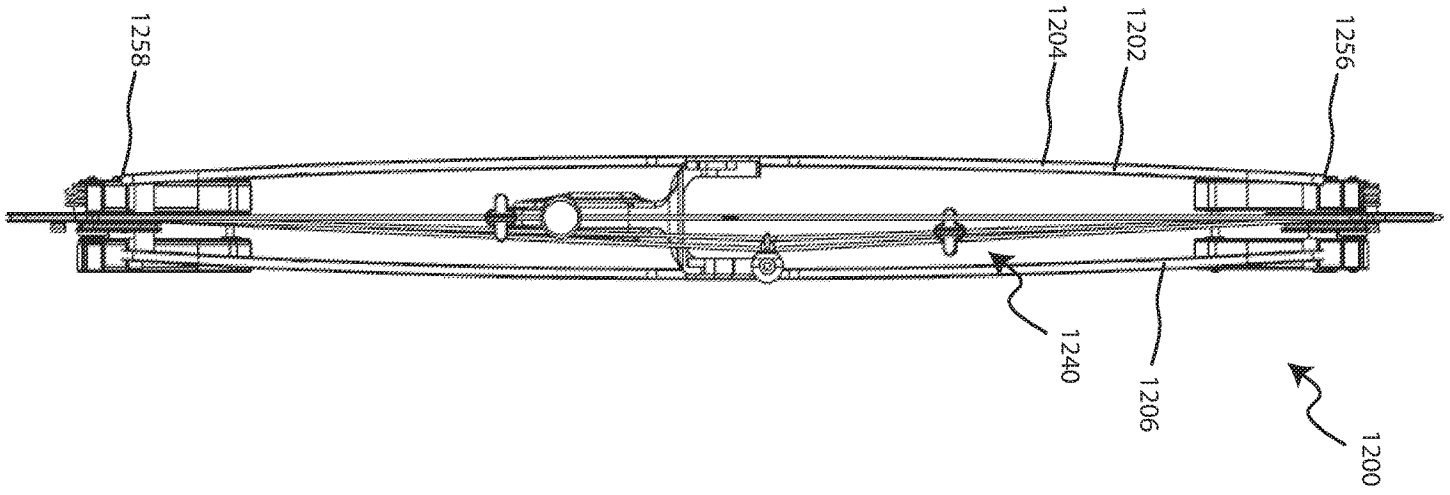
FIG. 12 is a rear view of a bow with the riser assembly of FIG. 11, according to an embodiment.

FIG. 12 shows a rear view of a bow 1200, according to an embodiment. The bow 1200 shown in FIG. 12 can be substantially similar to the bow 100 shown in FIGS. 1-6 and the bow 700 shown in FIGS. 7-10 except that the riser assembly 1202 includes convex riser plates 1204, 1206 (such as shown in FIG. 11) instead of the concave riser plates 102, 104, 702, 704. The bow 1200 can have similar axle to axle dimensions as the bow 700.

As seen in FIG. 12, the gap 1240 between the riser plates 1204, 1206 can have its largest width at a central location or midpoint between the two distal ends of the riser assembly 1202. In some embodiments, an arrow rest can be located at the midpoint, such that an arrow being shot from the bow 1200 is approximately equal distance from the top end 1256 of the riser assembly 1202 and the bottom end 1258 of the riser assembly 1202.

Figure 13:
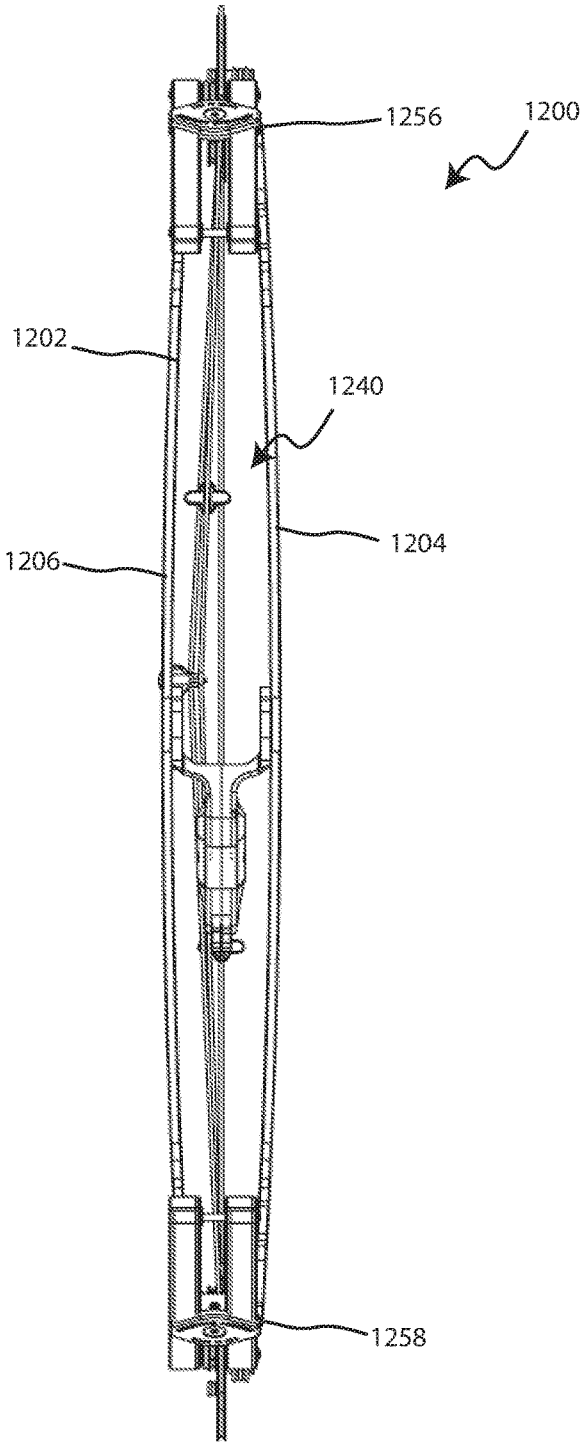
FIG. 13 is a front view of the bow of FIG. 12.

FIG. 13 shows a front view of the bow 1200, according to an embodiment. In comparison of the views shown in FIGS. 12 and 13 it can be seen that along a longitudinal or horizontal plane the gap 1240 can have a constant width, such that along the plane the width of the gap 1240 does not vary from the front of the riser assembly 1202 to the back of the riser assembly 1202.

Figure 14:
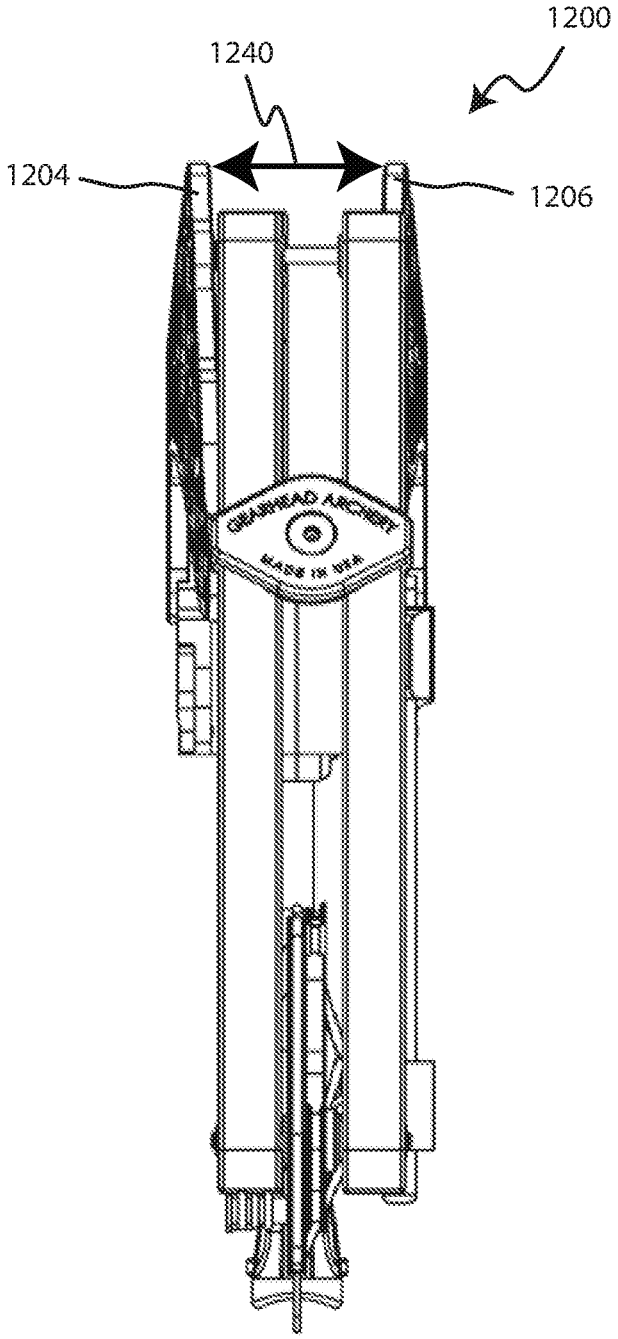
FIG. 14 is a top view of the bow of FIG. 12.

FIG. 14 shows a top view of the bow 1200, according to an embodiment. FIG. 14 shows the gap 1240 is at is narrowest point at the top end 1256 of the riser assembly 1202. When viewed from above, as shown in FIG. 14, it can be seen that the convex riser plates 1204, 1206 bow out, such that the gap 1240 is larger at a central location than it is at the top or bottom of the riser assembly 1202.

The riser plate assembly 102 of FIGS. 1-6 and the riser plate assembly 1102 of FIG. 11 are similar or identical in size to each other. The riser plate assembly 702 of FIGS. 7-10 and the riser plate assembly 1202 of FIGS. 12-14 are similar or identical in size to each other, and are larger than riser plate assemblies 102 and 1102.

A side view of bow 1200 would be identical to the side view of bow 700 shown in FIG. 7, because the side view of convex riser plate 1204 would be identical to the side view of concave riser plate 706 shown in FIG. 7.

In some embodiments, the riser plates can include a metal, such as steel, aluminum, or titanium. In various embodiments, the riser plates can have a substantially constant thickness, such that the thickness of the riser plate at one location is the same as the thickness of the riser plate at another location. In various embodiments, the thickness of a riser plate can be at least 0.05 inches and not more than 1 inch.

The limbs can be coupled to the first riser plate, the second riser plate, or both. The limbs can be coupled to the riser assembly to form an interior angle of between 180° and 90°. The limbs can be flexible, such that the limbs can flex or bend as the drawstring is drawn back by an archer, such as to store energy to propel an arrow when the archer releases the drawstring.

The limbs can be split limbs, such that each of the limbs can include two parallel limbs. In various embodiments, each limb can include two parts, such as a right limb part and a left limb part.

In an alternative embodiment, the limbs can each include a single limb with forked distal end. The forked distal end can be a separation of the limb, such as to form a "Y" shape. The forked distal end can be a split in the limb such as to form a separation. In various embodiments, one or more pulleys can be disposed within the forked distal end of each the first limb and the second limb, such as within the separation defined by the forked distal end.

The limbs can each include a proximal end that is coupled to the riser assembly. The limbs can each include a distal end that is coupled to the drawstring or a pulley. In some embodiments, at least a portion of the proximal ends of the limbs can be disposed between the first riser plate and the second riser plate. In some embodiments, the complete proximal ends of the limbs can be disposed between the first riser plate and the second riser plate.

In various embodiments, one or more riser connectors connect the first riser plate to the second riser plate. In various embodiments, the riser connectors are elongated members, such as a bar or dowel, coupled to the first riser plate and the second riser plate, such as to couple the plates with each other. The riser connectors can be disposed in a gap between the riser plates. In various embodiments, the proximal ends of the limbs can be coupled to riser connectors.

The bow can include one or more pulleys or cams. The first pulley can be coupled to the distal end of the first limb and the second pulley can be coupled to the distal end of the second limb. The first pulley can rotate around a first axle. The second pulley can rotate around a second axle. In various embodiments, the first pulley can include one or more pulleys and/or one or more cams. Similarly, the second pulley can include one or more pulleys and/or one or more cams.

The bow can include a drawstring extending from the first pulley to the second pulley. In other embodiments, the drawstring can extend from the distal end of the first limb to the distal end of the second limb. The drawstring can have a high tensile strength and/or a minimal amount of elasticity. The drawstring can be configured to transfer the energy from the bow to an arrow that is being shot from the bow. In some embodiments, the drawstring can include polyethylene, such as a high-modulus polyethylene, or plastic coated steel. In various embodiments, the drawstring is coupled to a D-loop, such as for the archer to use a release aid in combination with the bow.

The bow can further include one or more cables. The one or more cables can extend from the first pulley to the second pulley. In some embodiments, the bow can include two cables. The two cables can cross each other, such as to form an "X" shape (as shown in FIG. 1). The cables can provide additional energy to an arrow being shot from the bow. The cable(s) can aid the first pulley and second pulley in reducing the amount of force the archer needs to exert in order to further draw the drawstring back or to hold the drawstring in a drawn position.

In various embodiments, the bow can include a cable guide. The cable guide can be configured to guide the cable(s) out of the path of an arrow being shot by the bow or being prepared to be shot by the bow. In an embodiment, the cable guide can include a cable slide and a slide block. The slide block can be configured to slide along the cable slide, such as when the drawstring is drawn back. In an embodiment, the cable guide can include a pulley or roller to guide the cable(s) away from an arrow. The cable guide can be coupled to the handle. In an embodiment, the cable guide can be coupled to the first or second riser plate.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this invention pertains. All publications and patent applications are herein incorporated by reference to the same extent as if each individual publication or patent application was specifically and individually indicated by reference.

Aspects have been described with reference to various specific and preferred embodiments and techniques. However, it should be understood that many variations and modifications may be made while remaining within the spirit and scope herein.

The invention claimed is:

1. A bow, comprising:

a riser assembly comprising a first non-planar riser plate and a second non-planar riser plate, wherein the first non-planar riser plate and the second non-planar riser plate define a gap therebetween, the gap having a non-uniform width, the width being measured from a location on the first non-planar riser plate to a location on the second non-planar riser plate along a plane perpendicular to a plane defined by a drawstring;

a first limb and a second limb each coupled to and extending from ends of the riser assembly, wherein at least a portion of the first limb and at least a portion of the second limb are disposed in the gap between the first non-planar riser plate and the second non-planar riser plate; and the drawstring extending from the first limb to the second limb;

wherein an inner surface of the first non-planar riser plate and an inner surface of the second non-planar riser plate are concave or convex such that the width of the gap is non-uniform.

2. The bow of claim 1, further comprising:

a first pulley disposed at a distal end of the first limb;

a second pulley disposed at a distal end of the second limb;

a cable extending from the first pulley to the second pulley;

a handle coupled to the riser assembly; and a cable guide coupled to the handle or the riser assembly;

wherein the drawstring extends from the first pulley to the second pulley.

3. The bow of claim 1, wherein a vertical center plane in the gap defines a plane of symmetry for the riser assembly.

4. The bow of claim 1, wherein the gap comprises a widest portion and a narrowest portion, wherein a width of the widest portion of the gap is at least 1 inch and not more than 6 inches and a width of the narrowest portion of the gap is at least 0.5 inches and not more than 3 inches.

5. The bow of claim 1, wherein the width of the gap varies along a vertical plane of the riser assembly.

6. The bow of claim 1, wherein the first non-planar riser plate and the second non-planar riser plate each have a thickness of at least 0.05 inches and not more than 1 inch.

7. The bow of claim 1, wherein the width of the gap is constant along a longitudinal plane from a front of the riser assembly to a back of the riser assembly.

8. The bow of claim 1, wherein the first non-planar riser plate and the second non-planar riser plate are concave;

wherein the width of the gap is smaller at a central location than the width of the gap is at a location distal to the central location.

9. The bow of claim 8, wherein an outer surface of the first non-planar riser plate and an outer surface of the second non-planar riser plate are each concave.

10. The bow of claim 8, wherein an inner surface of the first non-planar riser plate and an inner surface of the second non-planar riser plate are each convex.

11. The bow of claim 10, wherein the inner surface of the first non-planar riser plate and the inner surface of the second non-planar riser plate define the gap.

12. The bow of claim 1, wherein the first non-planar riser plate and the second non-planar riser plate are convex;

wherein the width of the gap is larger at a central location than the width of the gap is at a location distal to the central location.

13. The bow of claim 12, wherein an outer surface of the first non-planar riser plate and an outer surface of the second non-planar riser plate are each convex.

14. The bow of claim 12, wherein an inner surface of the first non-planar riser plate and an inner surface of the second non-planar riser plate are each concave.

15. The bow of claim 14, wherein the inner surface of the first non-planar riser plate and the inner surface of the second non-planar riser plate define the gap.

16. A riser assembly for a bow, comprising:

a first non-planar riser plate; and a second non-planar riser plate coupled to the first non-planar riser plate with one or more connectors;

wherein the first non-planar riser plate and the second non-planar riser plate define a gap therebetween, a width of the gap extending from the first non-planar riser plate to the second non-planar riser plate;

wherein the width of the gap varies in size such that the width of the gap at a central location of the gap is smaller than the width of the gap at a location distal to the central location;

wherein an outer surface of the first non-planar riser plate and an outer surface of the second non-planar riser plate are each concave.

17. The riser assembly for a bow of claim 16, wherein an inner surface of the first non-planar riser plate and an inner surface of the second non-planar riser plate are each convex, and wherein the inner surface of the first non-planar riser plate and the inner surface of the second non-planar riser plate at least partially define the gap.

18. The riser assembly of claim 16, wherein the first non-planar riser plate and the second non-planar riser plate each have a thickness of at least 0.05 inches and not more than 1 inch.

19. A riser assembly for a bow, comprising:

a first non-planar riser plate; and a second non-planar riser plate coupled to the first non-planar riser plate with one or more connectors;

wherein the first non-planar riser plate and the second non-planar riser plate define a gap therebetween, a width of the gap extending from the first non-planar riser plate to the second non-planar riser plate;

wherein the width of the gap varies in size such that the width of the gap at a central location of the gap is larger than the width of the gap at a location distal to the central location;

wherein an outer surface of the first non-planar riser plate and an outer surface of the second non-planar riser plate are each convex.

20. The riser assembly for a bow of claim 19, wherein an inner surface of the first non-planar riser plate and an inner surface of the second non-planar riser plate are each concave, and wherein the inner surface of the first non-planar riser plate and the inner surface of the second non-planar riser plate at least partially define the gap.

* * * * *